US005535473A

United States Patent [19]

Maniar

[11] Patent Number: 5,535,473

[45] Date of Patent: Jul. 16, 1996

[54] DRAIN CLEANING APPARATUS

[76] Inventor: Mark A. Maniar, 1050 W. Maple St., Mapleton, Utah 84664

[21] Appl. No.: 349,317

[22] Filed: Dec. 5, 1994

[51] Int. Cl.[6] ..... B08B 9/02

[52] U.S. Cl. ..... 15/104.33; 15/104.12; 134/167 C

[58] Field of Search ..... 15/104.12, 104.33; 134/167 C

[56] References Cited

U.S. PATENT DOCUMENTS

| | | | |
|---|---|---|---|
| 2,710,980 | 6/1955 | Pletcher | 15/104.12 |
| 2,932,836 | 4/1960 | Pletcher | 15/104.12 |
| 3,167,126 | 1/1965 | Reineke, Jr. et al. . | |
| 3,171,150 | 3/1965 | Gray . | |
| 3,370,599 | 2/1968 | Claccio | 15/104.33 |
| 4,117,564 | 10/1978 | Russo . | |
| 4,257,139 | 3/1981 | Yeo . | |
| 4,271,556 | 6/1981 | Farrell, Jr. . | |
| 4,312,679 | 1/1982 | Klein, Sr. . | |
| 4,420,852 | 12/1983 | Bowlsby | 15/104.33 |
| 4,531,250 | 7/1985 | Watanabe | 15/104.12 |
| 4,677,997 | 7/1987 | Strauss . | |
| 4,773,113 | 9/1988 | Russell . | |
| 4,909,325 | 3/1990 | Hopmann . | |
| 5,179,753 | 1/1993 | Flaherty et al. | 15/104.12 |
| 5,244,505 | 9/1993 | Allison et al. . | |
| 5,253,664 | 10/1993 | Wilson | 134/167 C |

FOREIGN PATENT DOCUMENTS

| | | | |
|---|---|---|---|
| 277882 | 12/1951 | Switzerland | 15/104.12 |

OTHER PUBLICATIONS

Marco Dependable Snakes And Heads, Product Catalog, pp. 1–20.

*Primary Examiner*—Edward L. Roberts, Jr.
*Attorney, Agent, or Firm*—Thorpe, North & Western

[57] ABSTRACT

A drain cleaning system which utilizes a plumbing cable and nozzle assembly. A fluid-conveying hose is incorporated within a plumbing cable and a nozzle is affixed to the distal end of the cable and in communication with the hose. The nozzle includes a body having a rounded radius tip and a rotatably mounted ring having a plurality of radial jet passages formed therein. The ring and the body cooperatively define an annular passage therebetween. Pressurized water passes through the nozzle body and into the annular passage to produce a water bearing. The water is then discharged through the jet passages in the ring, causing the ring to rotate about the water bearing to produce a rotating spray of pressurized water. The rounded tip and ring are oriented co-axially with the tip being wider than the ring to prevent the jet passages from clogging when the nozzle is used to penetrate a clog in a pipe.

13 Claims, 1 Drawing Sheet

DRAIN CLEANING APPARATUS

BACKGROUND OF THE INVENTION

1. Field of the Invention

The present invention relates generally to methods and apparatus for unclogging drain pipes. More particularly, it concerns an anti-clog water jet nozzle designed specifically for a plumbing cable having an internal fluiding-conveying passageway.

2. The Backqround Art

Drain cleaning apparatus are known in the plumbing industry for dislodging and flushing clogs in drain pipes. The conventional prior art drain cleaning methods used to involve a two step process. In step 1, the operator feeds a plumbing cable, often referred to as a snake, through a drain pipe in order to push out, dislodge and otherwise unclog debris within the drain pipe. In step 2, the operator feeds a jet spray hose into the drain pipe, often utilizing a reverse spray nozzle which produces an annular backward spray of water. The water spray operates to dislodge and flush out clogs and other debris from the drain pipe.

Attempts have been made to improve the state of the drain cleaning art. For example, it is known to combine the plumbing cable and jet spray hose into a single cable member containing an internal co-axial hose which discharges a water spray from a nozzle affixed to the end of the cable. These cable hose combinations enable an operator to perform the two steps mentioned above in a single, easy step. Such cable hose combinations are disclosed in U.S. Pat. Nos. 4,773,113 (issued on Sep. 27, 1988 to Russell), 4,420,852 (issued on Dec. 20, 1983 to Bowlsby) and 4,312,679 (issued on Jan. 26, 1982 to Klein, Sr.).

However, the cable hose combinations which have been developed are characterized by a number of disadvantages and have therefore not come into general use. For example, one method of use is to insert the cable hose into a clogged pipe until its nozzled end is just upstream of the clog, then discharge a water spray to flush the clog on down the pipe. If the clog is not immediately broken up or dislodged, the result is that filthy water will back up quickly in the pipe and flood out through the inlet. Another method is to penetrate the clogging debris with the nozzled cable until the nozzle is just downstream from the clog, then discharge a backward water spray from the nozzle to slowly break apart the clog from its downstream end to thereby avoid backing-up and flooding. However, the nozzle holes are prone to become clogged when the nozzle penetrates the debris, requiring the operator to retrack the cable and clean out the nozzle, often three or more times before the nozzle can be placed downstream from the debris without becoming prohibitively clogged.

OBJECTS AND SUMMARY OF THE INVENTION

It is therefore an object of the present invention to provide a drain cleaning system which is less likely to become clogged during penetration of a clog in a pipe.

It is another object of the invention to provide such a system which is simple in design and less expensive to make.

It is a further object of the invention, in accordance with one aspect thereof, to provide such a system which is less likely to pierce the walls of a pipe during use.

It is an additional object of the invention, in accordance with one aspect thereof, to provide such a system which can produce fluid jets at higher pressures without causing permanent damage to the walls of a pipe being cleaned.

The above objects and others not specifically recited are realized in a specific illustrative embodiment of a drain cleaning system which utilizes a plumbing cable and nozzle assembly. A fluid-conveying hose is incorporated within a plumbing cable and a nozzle is affixed to the distal end of the cable and in communication with the hose. The nozzle includes a body having a tip and a rotatably mounted ring having a plurality of radial jet passages formed therein. The ring and the body cooperatively define an annular passage therebetween. Pressurized water passes through the nozzle body and into the annular passage to produce a water bearing. The water is then discharged through the jet passages in the ring, causing the ring to rotate about the water bearing to produce a rotating spray of pressurized water. The nozzle tip and ring are oriented co-axially with the tip being wider than the ring to prevent the jet passages from clogging when the nozzle is used to penetrate a clog in a pipe.

Additional objects and advantages of the invention will be set forth in the description which follows, and in part will be apparent from the description, or may be learned by the practice of the invention. The objects and advantages of the invention may be realized and obtained by means of the instruments and combinations particularly pointed out in the appended claims.

BRIEF DESCRIPTION OF THE DRAWINGS

The above and other objects, features and advantages of the invention will become apparent from a consideration of the subsequent detailed description presented in connection with the accompanying drawings in which.

DETAILED DESCRIPTION OF PRESENTLY PREFERRED EMBODIMENTS

Figure 1:
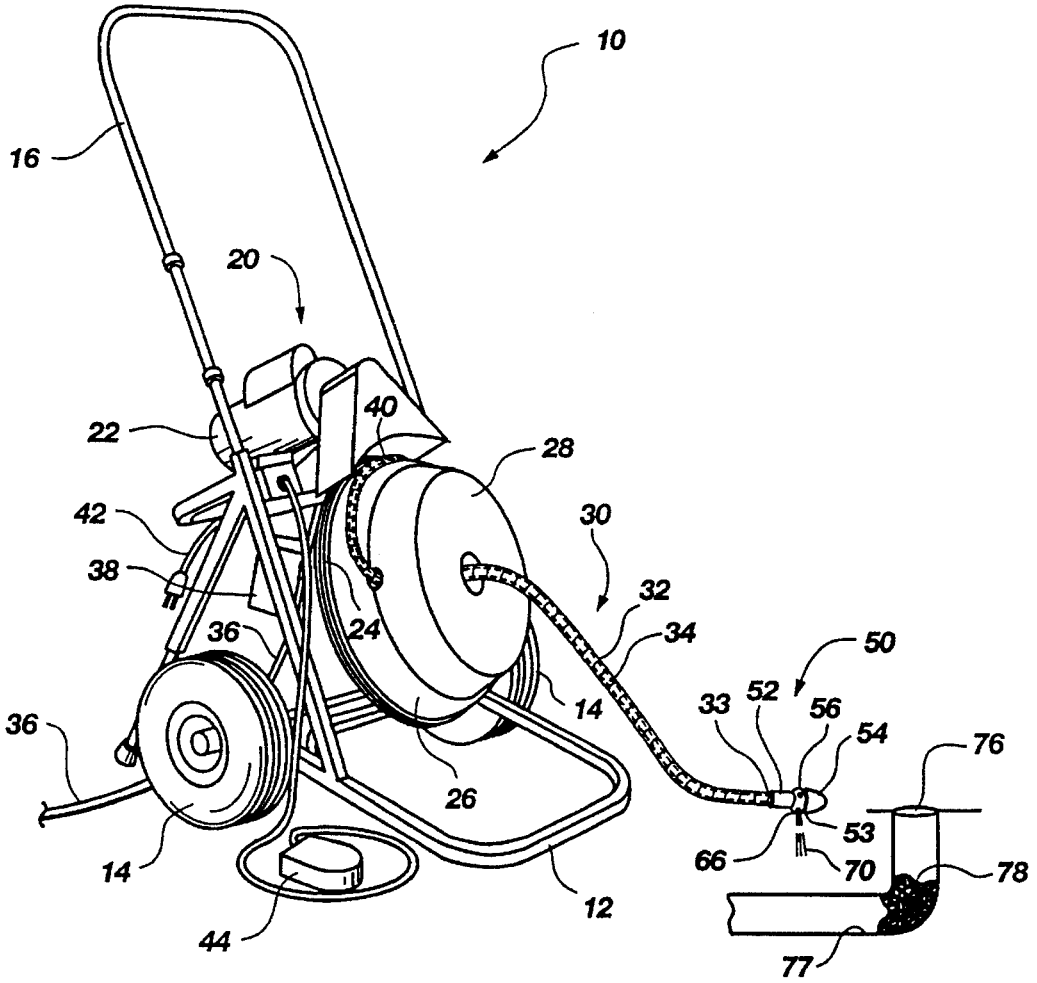
FIG. 1 is a perspective view of a portable drain cleaning system having an anti-clog nozzle, made in accordance with the principles of the present invention.

Referring now to FIG. 1, there is shown a portable drain cleaning system, generally designated at 10, made in accordance with the present invention. The system 10 includes a frame 12 which supports dual wheels 14 and a handle 16 secured to the frame 12. A user may tilt the frame 12 by pulling back on the handle 16 so that the entire system 10 rests upon the wheels 14 in order to wheel the system 10 from a first location to a second location.

A power assembly, generally designated at 20, is mounted on the frame 12 and includes a motor 22 and belt 24 which cooperate to impart rotational power to a drive wheel 26. Mounted upon the drive wheel 26 is a drum 28 containing a coiled cable hose, designated at 30, which includes an outer plumbing cable 32 circumscribing a co-axial inner hose 34 (shown in phantom line). A fluid such as water is supplied by a supply hose 36 to a pump 38 mounted to the frame 12. The pump 38 pumps the water at high pressure through a conduit 40 and into the cable hose 30. The motor 22 is electrically powered by a standard electrical cable 42 and a switch, such as a foot-actuated switch 44, is used to activate and deactivate the motor 22.

The cable hose 30 is arranged within the drum 28 in a manner known to those skilled in the art to permit the cable hose 30 to spin about its axis responsive to rotational motion of the drive wheel 26, without twisting the cable. If desired, the cable 32 can be rotatably disposed about the inner hose 34 and the conduit 40 can be a swivel conduit fixedly secured only to the cable 32, to enable the cable 32 to spin around the hose 34 without spinning the hose 34.

A nozzle, designated at 50, is attached to a distal end 33 of the cable 32. The nozzle 50 includes a nozzle body 52, a leading tip 54 disposed on a distal end 53 of the nozzle body 52, and a fluid-dispensing ring 56 rotatably mounted around the nozzle body 52. As shown most clearly in FIG. 2, the nozzle body 52 includes side walls 58 defining an internal chamber 60. The nozzle body 52 is disposed on the plumbing cable 32 such that the internal chamber 60 is disposed in communication with the inner hose 34.

Figure 2:
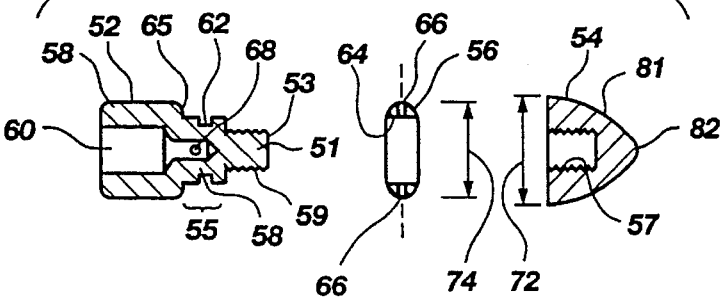
FIG. 2 is an exploded, cross-sectional view of a preferred embodiment of the nozzle of FIG. 1.

The fluid-dispensing ring 56 is rotatably mounted about a central section 55 of the nozzle body 52, and the ring 56 and body 52 cooperatively define a substantially enclosed annular passage 62 therebetween, as indicated by inspection of FIG. 2. There is a slight radial clearance between an inner surface 64 of the ring 56 and the outermost surface of the central section 55 of, for example, 5/1000 inches. The ring 56 has a plurality of jet passages 66 formed therein which communicate with the annular passage 62. The nozzle body 52 further includes at least one distribution port 68 (preferably two or more) extending from the internal chamber 60 through the side walls 58 and into communication with the annular passage 62.

Water is pumped from the inner hose 34 into the internal chamber 60, through the distribution ports 68 and into the annular passage 62 and the radial clearance between the ring 56 and nozzle body 52 to create a fluid bearing which supports the ring 56 in a sliding, rotatable disposition. The water then passes through the jet passages 66 of the ring 56 which causes the ring 56 to rotate and produces rotating jets 70 (FIG. 1) of pressurized water projecting outwardly from the ring.

The ring 56 is held in its rotatable disposition between a shoulder 65 of the nozzle body 52 and the tip 54. The tip 54 is secured onto a neck 51 of the nozzle body 52 by its female threads 57 being engaged with male threads 59 of the neck 51. Sealing gaskets (not shown) or the like may be provided as known in the art to seal the rotating ring 56 such that water passing into the annular passage 62 is only discharged from the jet passages 66. However, such sealing apparatus is optional and not necessary.

The leading tip 54 has a larger width 72 than an outer diameter 74 of the fluid-dispensing ring 56. The width 72 of the tip 54 is also wider than the nozzle body 52 and the cable hose 30. The tip 54 is secured to the distal end 53 of the nozzle body 52, preferably in co-axial orientation therewith, such that the width 72 of the tip extends laterally outward from the nozzle body 52 beyond the outer diameter 74 of the ring 56.

Referring now to FIGS. 1–2, the cable hose 30 is fed into a drain 76 (FIG. 1) having a clogging debris 78 in a manner known to those skilled in the art. The debris 78 can range from a solid grease clog to a soupy sludge. The leading tip 54 penetrates the clog 78 to position the nozzle 50 downstream from the clog 78. The motor 22 can be actuated to spin the cable 32, and thus the fixedly-attached nozzle body 52 and tip 54, about its axis to aid in penetrating the clog debris 78. The pump 38 can be selectively actuated at any time to create the rotating jets 70 of pressurized water to aid in breaking up the clog debris 78 and flush it downstream through the pipe 76.

The system 10 has particular utility in removing clogs in commercial drains. There is often an extraordinarily large amount of solid matter such as dirt and grease in commercial drain pipes. The dirt and grease produce clogs so thick that they could be machined. In such cases, the prior art drain cleaners usually become clogged themselves if they try to penetrate the solid clog because the grease and dirt from the clog become lodged within the nozzle holes. Conversely, if an operator discharges a water spray upstream from the clog in an attempt to fragment or dislodge it, the water quickly backs up and floods out through the inlet end of the drain pipe.

However, applicant has discovered that when the leading tip 54 penetrates a solid grease clog, the tip 54 forms a stable pilot hole within the grease. Because the width 72 of the tip 54 is wider than the diameter 74 of the ring 56 and is wider than the nozzle body 52 and cable 32, it acts as a shield as it pushes through a solid dirt-and-grease clog to prevent the jet passages 66 in the ring 56 from clogging. Since the diameter of the pilot hole produced by the tip 54 is necessarily wider than the ring 56, grease from the clog is prevented from entering the jet passages 66. Once the nozzle 50 is positioned downstream from the clog 78, the pump 38 is actuated to produce the pressurized rotating jet spray 70, and the operator slowly retracts the cable hose 30 to slowly fragment and flush the clog downstream, piece by piece.

Figure 3:
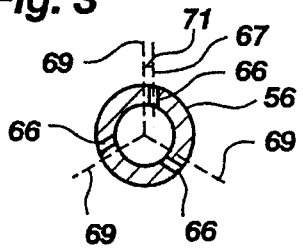
FIG. 3 is a cross-sectional view of a fluid-dispensing ring of the nozzle of FIG. 2.

Referring now to FIG. 3, applicant has discovered that higher flows of water and stronger jet streams 70 can be produced by a particular orientation of the jet passages 66. More specifically, each jet passage 66 defines an axis 67 which is parallel to and offset from a plane 69 that is common to the central axis of the fluid-dispensing ring 56. The axis 67 is offset by a distance 71. Applicant has found that this particular orientation of the jet passages 66 allows the water pumped into the ring 56 to cause rotation of the ring 56 at a desirably moderate rotational velocity, thus permitting a more rapid flow distribution of water through the jet passages 66 as compared with a faster-rotating ring.

Figure 4:
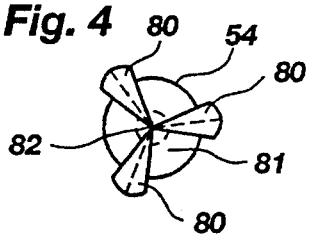
FIG. 4 is a front view of the tip of the nozzle of FIG. 2.

Referring now to FIG. 4, the tip 54 preferably includes a plurality of cutting blades 80 disposed on its outer surface 81 to aid in penetrating the clog 78. The tip 54 includes a distal extremity 82 which is preferably a rounded, radius tip, and may in the alternative comprise a sharp-pointed tip. The outer surface 81 of the tip 54 is preferably of convex surface geometry which aids in preventing the distal extremity 82 from piercing the walls 77 of the pipe 76, as opposed to a perfectly conical tip which would tend to puncture the pipe walls 77. More specifically, when the cable hose 30 is advanced into the pipe 76, the convex surface 54 operates to abut the walls 77 before the distal extremity 82 has a chance to pierce the walls 77. Further, when the extremity 82 is rounded with a definite radius as is preferred, the extremity 82 tends to bounce off burrs which are a prevalent part of the inner surface of metal pipes, and is thus less likely to become caught upon the burrs. A sharp-pointed tip is more likely to catch on the burrs, causing the tip 54 to drill through the walls 77 of the pipe 76.

A preferred method for cleaning a clogged pipe, in accordance with the principles of the present invention, comprises the steps of:

(a) forcing a nozzle through material clogging the pipe, said nozzle including a nozzle body having a distal tip and a fluid-dispensing ring being rotatably disposed about the nozzle body and having jet passages formed therein, said nozzle body having an internal chamber disposed in communication with the jet passages of the fluid-dispensing ring;

(b) discharging pressurized fluid into the internal chamber of the nozzle body and out through the jet passages of the ring after the nozzle has passed through the material clogging the pipe to thereby cause the ring to rotate so as to produce rotating jets of pressurized fluid projecting outward from the ring to further dislodge and flush the unwanted debris; and (c) pulling the nozzle backwards toward the material clogging the pipe while continuing to discharge pressurized fluid through the jet passages of the ring.

This exemplary method is augmented when the distal tip has a larger width than an outer diameter of the fluid-dispensing ring such that the width of the tip extends laterally outward from the nozzle body beyond the outer diameter of the ring, so that step (a) above further comprises advancing the tip through the material clogging the pipe to thereby produce a pilot hole within said material which is wider than the fluid-dispensing ring to thereby avoid clogging the jet passages with said material. The blades 80 preferably have rounded shoulders at their lower ends (i.e. the ends farthest from the tip end 82) which helps prevent the blades 80 from catching on the pipe when pulled backward through an elbow or other non-linear pipe section.

It will thus be appreciated that the prior art cable hoses and rotating nozzles fail to solve adequately the problems of dislodging and flushing out clogs in drains, especially clogs in commercial drains which are often made up of machinable solid grease and dirt. Some prior art nozzles are designed to discharge the pressurized water from the leading tip. However, since the leading tip in such prior art systems is rotatable relative to the plumbing cable, motorized rotation of the cable fails to rotate the leading tip adequately, if at all, during penetration of the clog 78. It is readily understandable to those skilled in the art that a rotating tip as in the present invention is much more effective in penetrating a clog in a drain pipe. Further, since the invention provides a separate water-dispensing ring 56 which is less wide than the leading tip 54, the tip 54 acts as a shield when penetrating clog debris 78 to thereby prevent the debris from entering the jet passages 66. Nothing in the level of ordinary plumbing skill or in the prior art known to applicant provides this structure or its resulting advantages.

The offset distance 71 of the jet passages 66 enables the system 10 to operate at a higher water pressure without damaging the walls 77 of the pipe 78. Applicant has found that when the jet passages of any rotating, water-dispensing element are not offset from the planes 69, the water jets 70 tend to erode and even pierce the walls 77 of the pipe 78 above a certain pressure level. The offset distance 71 of the jet passages 66 enables a much higher operating pressure without causing damage to the pipe. Presently, applicant has operated the system 10 at pressures of 1200 psi without damaging the drain pipes being cleaned.

The system 10 thus enables an operator to fragment the clog 78 piece by piece from the downstream end and at a much higher operating pressure, which is highly advantageous when clearing debris which has accumulated within a horizontal sagging section of a pipe. Such a horizontal sagging pipe section, often called a "belly", is known to occur in approximately twenty percent of all pipes and is typically caused by the pipe being insufficiently supported. A belly is usually a few feet long and more readily accumulates clog-producing debris therein. The water pressure in the cleaning nozzles known to applicant is unable to simply sweep the debris out of the belly from the upstream end. Debris which has accumulated in the belly has been removed in the past by passing a cable wrapped in rags through the belly to soak up the debris, and by scouring the belly with a scouring brush in order the dislodge all debris from the pipe. This prior art method is very disadvantageous, because the cable with rags must be passed in and out of the pipe numerous times in order to soak up all of the debris. Further, the scouring brush often produces scouring marks and grooves in the pipe walls which damages the pipe and causes debris to accumulate almost immediately in the grooves and thus more quickly, said debris being even more difficult to remove in the future. Applicant's combination of dislodging the debris piece by piece from the downstream end and at higher operating pressures (such as 1200 psi, for example) has been found capable of sweeping out bellies of up to five feet long very thoroughly.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

What is claimed is:

1. A drain cleaning nozzle assembly comprising:

a nozzle body having a distal end and side walls defining an internal chamber configured for receiving pressurized fluid therein;

a fluid-dispensing ring being rotatably disposed around the nozzle body such that the body and the ring define a substantially enclosed annular passage therebetween, said ring having a plurality of jet passages formed therein which communicate with the annular passage, wherein the nozzle body further includes at least one distribution port extending from the internal chamber through the side walls and into communication with the annular passage; and a leading tip disposed on the distal end of the nozzle body; wherein the fluid-dispensing ring has an outer diameter and wherein the leading tip has a width which is wider than the outer diameter of the ring, as well as being wider than the nozzle body, such that the width of the tip extends laterally outward from the nozzle body beyond the outer diameter of the ring and side walls of the nozzle body.

2. A nozzle assembly as defined in claim 1, wherein the nozzle body is configured for attachment to a plumbing cable having an internal pressurized fluid supply line for injecting pressurized fluid into the internal chamber of the nozzle body, such that when the plumbing cable is fed into a pipe containing unwanted debris, ffhe leading tip operates to penetrate the debris, and wherein there exists radial clearance between the fluid-dispensing ring and the nozzle body at the annular passage such that the pressurized fluid passes through the distribution port and into the annular passage to produce a fluid bearing between the ring and the nozzle body, the jet passages of the ring being oriented such that passage of the pressurized fluid from the annular passage through the jet passages causes rotation of the ring and rotating jets of pressurized fluid projecting outward from the ring to dislodge and flush downstream the unwanted debris.

3. A nozzle assembly as defined in claim 1, wherein the leading tip includes an outer surface having cutting blades disposed thereon to aid in penetrating unwanted debris clogging a pipe.

4. A nozzle assembly as defined in claim 1, wherein the leading tip includes a rounded distal extremity having a radius.

5. A nozzle assembly as defined in claim 4, said leading tip further including a convex outer surface for inhibiting penetration of said distal extremity into walls of a pipe.

6. A nozzle assembly as defined in claim 1, wherein the fluid-dispensing ring defines an axis and wherein each jet passage defines an axis which is parallel to and offset from a plane common to the axis of the fluid-dispensing ring to thereby cause rotation of the ring about the nozzle body responsive to passage of pressurized fluid through the jet passages.

7. A nozzle assembly as defined in claim 6, wherein the offset of the jet passages is sufficient to permit fluid to be dispensed from said jet passages at pressures of up to approximately 1200 psi without causing permanent damage to a pipe being cleaned with the nozzle assembly.

8. A drain cleaning apparatus comprising:

elongate fluid supply means for selectively supplying pressurized fluid;

elongate plumbing cable means surrounding a length of the fluid supply means;

a nozzle body having a distal end and side walls defining an internal chamber, said nozzle body being disposed on the plumbing cable means such that said internal chamber is disposed in communication with the fluid supply means;

a fluid-dispensing ring having an outer diameter and being rotatably disposed around the nozzle body such that the body and the ring define a substantially enclosed annular passage therebetween, said ring having a plurality of jet passages formed therein which communicate with the annular passage, wherein the nozzle body further includes at least one distribution port extending from the internal chamber through the side walls and into communication with the annular passage;

a leading tip having a larger width than the nozzle body, plumbing cable means and outer diameter of the fluid-dispensing ring, said tip being disposed on the distal end of the nozzle body such that the width of the tip extends laterally outward from the nozzle body and plumbing cable means to beyond the outer diameter of the ring and side walls of the nozzle body;

such that when the plumbing cable is fed into a pipe containing unwanted debris, the leading tip operates to penetrate the debris and pressurized fluid selectively supplied by the fluid supply means passes through the distribution port and into the annular passage to produce a fluid bearing between the ring and the nozzle body, the jet passages of the ring being oriented such that passage of the pressurized fluid from the annular passage through said jet passages causes rotation of the ring and rotating jets of pressurized fluid projecting outwardly from the ring to dislodge and flush downstream the unwanted debris.

9. A nozzle assembly as defined in claim 8, wherein the leading tip is fixedly attached to the distal end of the nozzle body and the nozzle body is fixedly attached to the plumbing cable means, said plumbing cable means having an axis, said nozzle assembly further comprising:

means for spinning the plumbing cable means about its axis to aid in advancing the leading tip and the plumbing cable means through unwanted debris lodged in a pipe.

10. A nozzle assembly as defined in claim 9, wherein the fluid-dispensing ring defines an axis and wherein each jet passage defines an axis which is parallel to and offset from a plane common to the axis of the fluid-dispensing ring to thereby cause rotation of the ring about the nozzle body responsive to passage of pressurized fluid through the jet passages.

11. A nozzle assembly as defined in claim 10, wherein the leading tip includes an outer surface having cutting blades disposed thereon to aid in penetrating unwanted debris clogging a pipe.

12. A nozzle assembly as defined in claim 11, wherein the leading tip includes a rounded distal extremity having a radius.

13. A nozzle assembly as defined in claim 12, said leading tip further including a convex outer surface for inhibiting penetration of said distal extremity into walls of a pipe.

* * * * *